US008558719B2

(12) United States Patent
Yamada

(10) Patent No.: US 8,558,719 B2
(45) Date of Patent: Oct. 15, 2013

(54) DRIVE SUPPORT DEVICE FOR INDICATING THE STATUS OF A TRAFFIC SIGNAL TO A DRIVER

(75) Inventor: Yuki Yamada, Susono (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 20 days.

(21) Appl. No.: 13/142,221

(22) PCT Filed: Dec. 26, 2008

(86) PCT No.: PCT/JP2008/073728

§ 371 (c)(1),
(2), (4) Date: Jun. 24, 2011

(87) PCT Pub. No.: WO2010/073368

PCT Pub. Date: Jul. 1, 2010

(65) Prior Publication Data

US 2011/0254702 A1 Oct. 20, 2011

(51) Int. Cl.
*G08B 21/00* (2006.01)

(52) U.S. Cl.
USPC ..... 340/905; 340/901

(58) Field of Classification Search
USPC ..... 340/901–905, 933, 438
See application file for complete search history.

(56) References Cited

U.S. PATENT DOCUMENTS 6,262,673 B1 * 7/2001 Kalina ..... 340/901

FOREIGN PATENT DOCUMENTS

| | | | |
|---|---|---|---|
| DE | 20 2004 003 215 | U1 | 4/2004 |
| DE | 10 2007 002 499 | A1 | 7/2008 |
| JP | 08-002285 | A | 1/1996 |
| JP | 10-214396 | A | 8/1998 |
| JP | 2001188991 | | 7/2001 |
| JP | 2003-077093 | A | 3/2003 |
| JP | 2004-171459 | A | 6/2004 |
| JP | 2005-247265 | A | 9/2005 |
| JP | 2008-033774 | A | 2/2008 |

OTHER PUBLICATIONS

Search Report dated Nov. 7, 2012 in EP Application No. 08879164.5.
International Search Report dated Jan. 27, 2009 of PCT/JP2008/073728.
International Preliminary Report on Patentability of PCT/JP2008/073728.

* cited by examiner

*Primary Examiner* — Jeffery Hofsass
(74) *Attorney, Agent, or Firm* — Kenyon & Kenyon LLP

(57) ABSTRACT

Disclosed is a drive support device in which a receiver acquires time-series signal information relating to the lighting state of a signal, and a display and a speaker provide the signal information acquired by the receiver through at east one of screen display and voice. The display and the speaker provide information created on the basis of the signal information while preventing at least any timing of the start of providing the information created on the basis of the signal information, the end of providing the information created on the basis of the signal information, and changing the information created on the basis of the signal information to be provided from being synchronized with the timing at which the lighting state of the signal changes. Thus, the timing becomes inconsistent with the change of the lighting state of the signal, making it impossible for a driver to estimate the lighting state of the signal from information to be provided. Therefore, it becomes possible to prevent the driver from neglecting the confirmation of the signal.

10 Claims, 4 Drawing Sheets

DRIVE SUPPORT DEVICE FOR INDICATING THE STATUS OF A TRAFFIC SIGNAL TO A DRIVER

This is a 371 national phase application of PCT/JP2008/073728 filed 26 Dec. 2008, the contents of which are incorporated herein by reference.

TECHNICAL FIELD

The present invention relates to a drive support device, and in particular, to a drive support device which carries out drive support in accordance with time-series signal information relating to the lighting state of a signal.

BACKGROUND ART

A device which carries out drive support in accordance with the time-series signal information relating to the lighting state of the signal has been suggested. For example, Patent Literature 1 describes a system in which a DSRC transmitter which sends signal information is provided in a signal, and an in-vehicle device is mounted in a vehicle. In this system, the signal information is received by a DSRC receiver of the in-vehicle device, the timing of changing the lighting state of the signal is obtained from the received information, and the lighting state of the signal and the change timing are displayed on a display of the in-vehicle device. Thus, traveling can be made after a driver has been aware of the time until the lighting state of the signal changes.

[Patent Literature 1] Japanese Unexamined Patent Application Publication No. 2004-171459

SUMMARY OF INVENTION

Technical Problem

However, according to the above-described technique, when the provision of information relating to the lighting state of the signal or information for carrying out drive support based on signal information starts, ends, or changes at the timing of switching the lighting color of the signal, a driver may estimate the lighting state of the signal from information to be provided from the system and may neglect the visual confirmation of the actual signal.

The invention has been finalized in consideration of the above-described situation, and an object of the invention is to provide a drive support device capable of preventing a driver from neglecting the confirmation of a signal.

Solution To Problem

The invention provides a drive support device. The drive support device includes an acquisition unit which acquires time-series signal information relating to the lighting state of a signal, and information providing means for providing information created on the basis of the signal information acquired by the acquisition unit through at least one of screen display and voice. The information providing means provides the signal information while preventing at least any timing of the start of providing the information created on the basis of the signal information, the end of providing the information created on the basis of the signal information, and changing the information created on the basis of the signal information to be provided from being synchronized with the timing at which the lighting state of the signal changes.

With this configuration, in the drive support device in which the acquisition unit acquires the time-series signal information relating to the lighting state of the signal, and the information providing means provides the information created on the basis of the signal information acquired by the acquisition unit through at least one of screen display and voice, the information providing means provides the information created on the basis of the signal information while preventing at least any timing of the start of providing the information created on the basis of the signal information, the end of providing the information created on the basis of the signal information, and changing the information created on the basis of the signal information to be provided from being synchronized with the timing at which the lighting state of the signal changes. Thus, the timing becomes inconsistent with the change of the lighting state of the signal, making it impossible for the driver to estimate the lighting state of the signal from the information to be provided. Therefore, it becomes possible to prevent the driver from neglecting the confirmation of the signal.

In this case, it is preferable that the information providing means provides the information created on the basis of the signal information through screen display.

With this configuration, the information providing means provides the information created on the basis of the signal information through screen display, and the timing of the start and end of providing the information and changing the information becomes inconsistent with the change of the lighting state of the signal. Therefore, it becomes possible to prevent the driver from neglecting the visual confirmation of the signal.

It is preferable that the information providing means provides the information created on the basis of the signal information while setting at least any timing of the start of providing the information created on the basis of the signal information, the end of providing the information created on the basis of the signal information, and changing the information created on the basis of the signal information to be provided as when a predetermined time elapses after the lighting state of the signal changes.

With this configuration, the information providing means provides the information created on the basis of the signal information while setting at least any timing of the start of providing the information created on the basis of the signal information, the end of providing the information created on the basis of the signal information, and changing the information created on the basis of the signal information to be provided as when a predetermined time elapses after the lighting state of the signal changes. Therefore, it is necessary for the driver to confirm the lighting state of the signal after having been actually changed, making it possible to more reliably prevent the driver from neglecting the confirmation of the signal.

It is preferable that the information providing means provides the information created on the basis of the signal information while setting at least any timing of the start of providing the information created on the basis of the signal information, the end of providing the information created on the basis of the signal information, and changing the information created on the basis of the signal information to be provided as when the vehicle state quantity of a host vehicle is in a predetermined state.

With this configuration, the information providing means provides the information created on the basis of the signal information while setting at least any timing of the start of providing the information created on the basis of the signal information, the end of providing the information created on the basis of the signal information, and changing the information created on the basis of the signal information to be provided as when the vehicle state quantity of the host vehicle unrelated to the timing at which the lighting state of the signal changes is in a predetermined state. Therefore, it is possible to prevent the timing of the start of the information created on the basis of the provision of the signal information or the like from being consistent with the timing at which the lighting state of the signal changes, making it possible to prevent the driver from neglecting the confirmation of the signal.

In this case, it is preferable that the vehicle state quantity is at least one of the vehicle speed, the traveling distance, and the position of the host vehicle.

With this configuration, when at least one of the vehicle speed, the traveling distance, and the position of the host vehicle unrelated to the timing at which the lighting state of the signal changes is in a predetermined state, the information providing means starts to provide the information created on the basis of the signal information or the like. Therefore, it is possible to prevent the timing of the start of providing the information created on the basis of the signal information or the like from being consistent with the timing at which the lighting state of the signal changes, making it possible to prevent the driver from neglecting the confirmation of the signal.

The invention also provides a drive support device. The drive support device includes an acquisition section which acquires time-series signal information relating to the lighting state of a signal, and drive support means for carrying out drive support of a host vehicle using the signal information acquired by the acquisition section. The drive support means carries out the drive support while preventing at least any timing of the start of the drive support and the end of the drive support from being synchronized with the timing at which the lighting state of the signal changes.

With this configuration, in the drive support device in which the acquisition section acquires the time-series signal information relating to the lighting state of the signal, and the drive support means carries out drive support of the host vehicle using the signal information acquired by the acquisition section, the drive support means carries out the drive support while preventing at least any timing of the start of the drive support and the end of the drive support from being synchronized with the timing at which the lighting state of the signal changes. Thus, the timing becomes inconsistent with the change of the lighting state of the signal, making it impossible for the driver to estimate the lighting state of the signal from the timing of the start of drive support or the like. Therefore, it becomes possible to prevent the driver from neglecting the confirmation of the signal.

In this case, it is preferable that the drive support means controls the brake of the host vehicle to carry out the drive support.

With this configuration, the drive support means carries out the drive support while preventing the timing of the start of brake control or the like for most directly coping with the change in the lighting color of the signal from being synchronized with the timing at which the lighting state of the signal changes. Thus, the timing of the start of brake control or the like becomes inconsistent with the change of the lighting state of the signal, making it impossible for the driver to estimate the lighting state of the signal from the timing of the start of brake control or the like. Therefore, it becomes possible to prevent the driver from neglecting the confirmation of the signal.

Advantageous Effects of Invention

According to the drive support device of the invention, it becomes possible to prevent the driver from neglecting the confirmation of the signal.

REFERENCE SIGNS LIST

Figure 1:
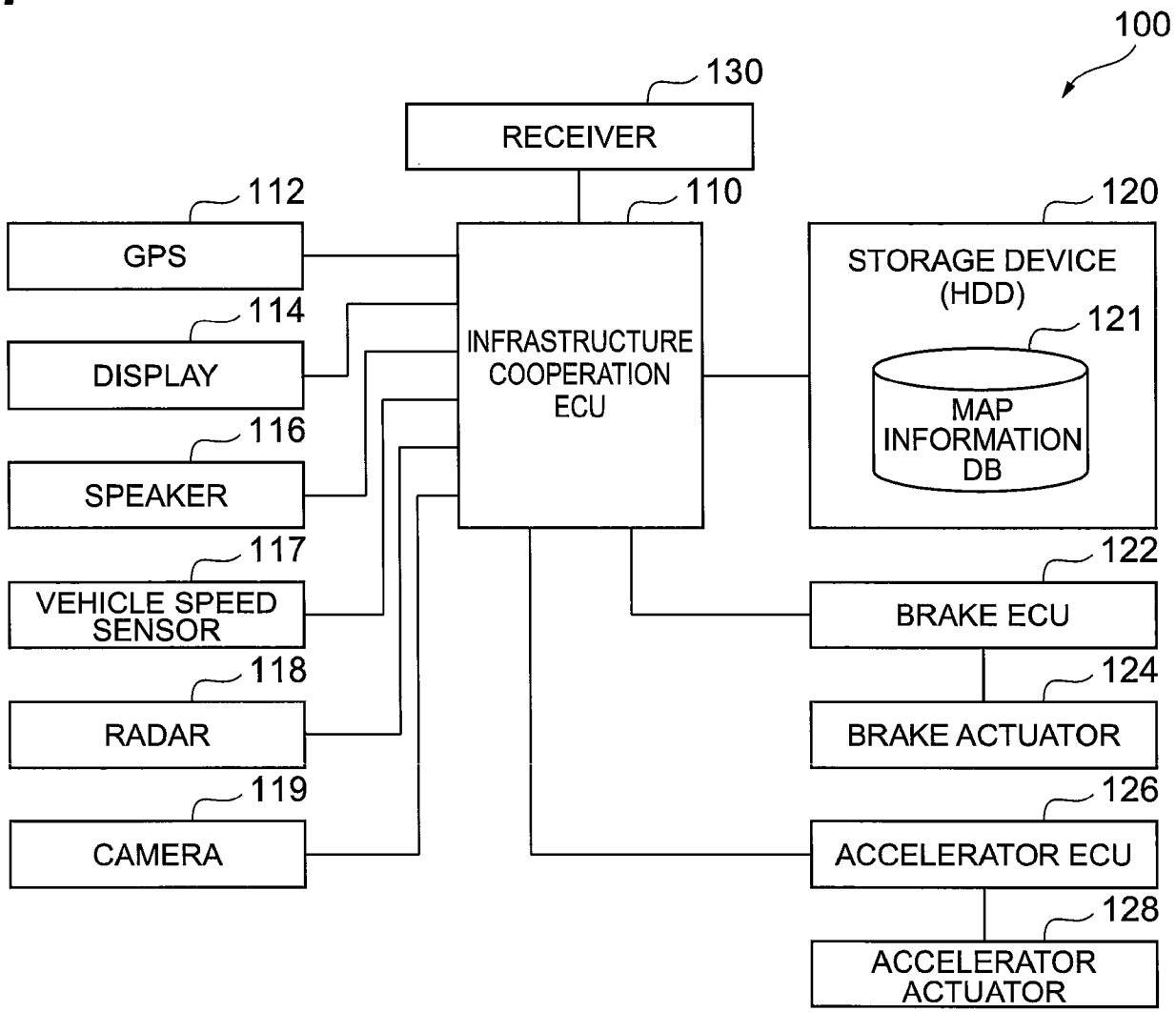
FIG. 1 is a block diagram showing the configuration of a drive support device according to a first embodiment.

100: drive support device
110: infrastructure cooperation ECU
112: GPS
114: display
116: speaker
117: vehicle speed sensor
118: radar
119: camera
120: storage device (HDD)
121: map information DB
122: brake ECU
124: brake actuator
126: accelerator ECU
128: accelerator actuator
130: receiver
200: screen display
210: 2D map display
220: 3D driver's view display
230: service execution display icon
240: signal remaining time display icon
250: signal cycle display bar
251: acquired signal cycle time display

DESCRIPTION OF EMBODIMENTS

Hereinafter, embodiments of a drive support device according to the invention will be described with reference to the drawings. Of the drawings, FIG. 1 is a block diagram showing the configuration of a drive support device according to a first embodiment.

As shown in FIG. 1, a drive support device 100 of this embodiment is configured such that a GPS 112, a display 114, a speaker 116, a vehicle speed sensor 117, a radar 118, a camera 119, a storage device (HDD) 120, a brake ECU 122, an accelerator ECU 126, and a receiver 130 are connected to an infrastructure cooperation ECU 110. The drive support device of this embodiment is a device which carries out drive support by cooperatively controlling time-series signal information relating to the lighting state of a signal received from a road-side infrastructure, such as an optical beacon transmitter, by the receiver 130 and information of navigation of the GPS 112 and the storage device 120.

The GPS (Global Positioning System) 112 receives signals from a plurality of GPS satellites by a GPS receiver and measures the position of the host vehicle from a difference between the signals.

As described below, the display (information providing means) 114 provides lighting time information relating to a remaining time until the red signal of the signal changes or information, such as "transmission is impossible" or "start is possible", created on the basis of the signal information to the driver through screen display. The speaker (information providing means) 116 provides lighting time information relating to a remaining time until the red signal of the signal changes or the like to the driver through voice.

The vehicle speed sensor 117 detects the rotation speed of the axle to detect the vehicle speed of the host vehicle.

The radar 118 is used to obtain the speed (including relative speed) and deceleration of a preceding vehicle in front of the host vehicle, the inter-vehicle distance between the preceding vehicle and the host vehicle, and the inter-vehicle time between the preceding vehicle and the host vehicle. The radar 118 is a sensor which irradiates electromagnetic waves such as millimeter waves forward, receives reflected waves reflected by an object, and detects the speed and deceleration of the preceding vehicle, the inter-vehicle distance between the preceding vehicle and the host vehicle, and the inter-vehicle time between the preceding vehicle and the host vehicle.

The camera 119 is used to capture the image of the preceding vehicle in front of the host vehicle and obtain the speed (including relative speed) and deceleration of the preceding vehicle, the inter-vehicle distance between the preceding vehicle and the host vehicle, and the inter-vehicle time between the preceding vehicle and the host vehicle.

Specifically, the receiver (acquisition means) 130 is an optical beacon receiver or a vehicle-to-vehicle communication device and acquires time-series signal information relating to the lighting state of a signal transmitted from an optical beacon transmitter of a road-side infrastructure or another vehicle. The time-series signal information relating to the lighting state of the signal includes lighting time information relating to a remaining time until the red signal of the signal changes.

The storage device (HDD: hard disk drive) has a map information DB 121 in which map information is recorded, and from the map information DB 121, the infrastructure cooperation ECU acquires information relating to a route on which the host vehicle is traveling, a traveling distance, and the like in conjunction with the positioning information of the host vehicle obtained by the GPS 112. Alternatively, the storage device 120 records previous time-series signal information relating to the lighting state of the signal at each location.

The infrastructure cooperation ECU 110 provides lighting time information relating to a remaining time until the red signal of the signal changes or the like to the driver by the display 114 and the speaker 116 on the basis of time-series signal information relating to the lighting state of the signal received from the optical beacon transmitter by the receiver 130, positioning information of the GPS 112 and information relating to a route on which the host vehicle is traveling, a traveling distance, and the like obtained from the map information DB 121, the vehicle speed of the host vehicle acquired by the vehicle speed sensor 117, information relating to a preceding vehicle acquired by the radar 118 and the camera 119, and previous time-series signal information relating to the lighting state of the signal at each location recorded in the storage device 120, and performs brake control by the brake ECU 122 and accelerator control by the accelerator ECU to carry out drive support.

The brake ECU (drive support means) 122 drives the brake actuator 124 on the basis of a command from the infrastructure cooperation ECU 110 to carry out brake control. The accelerator ECU (drive support means) 126 drives the accelerator actuator 128 on the basis of a command from the infrastructure cooperation ECU 110 to carry out brake control.

Figure 2:
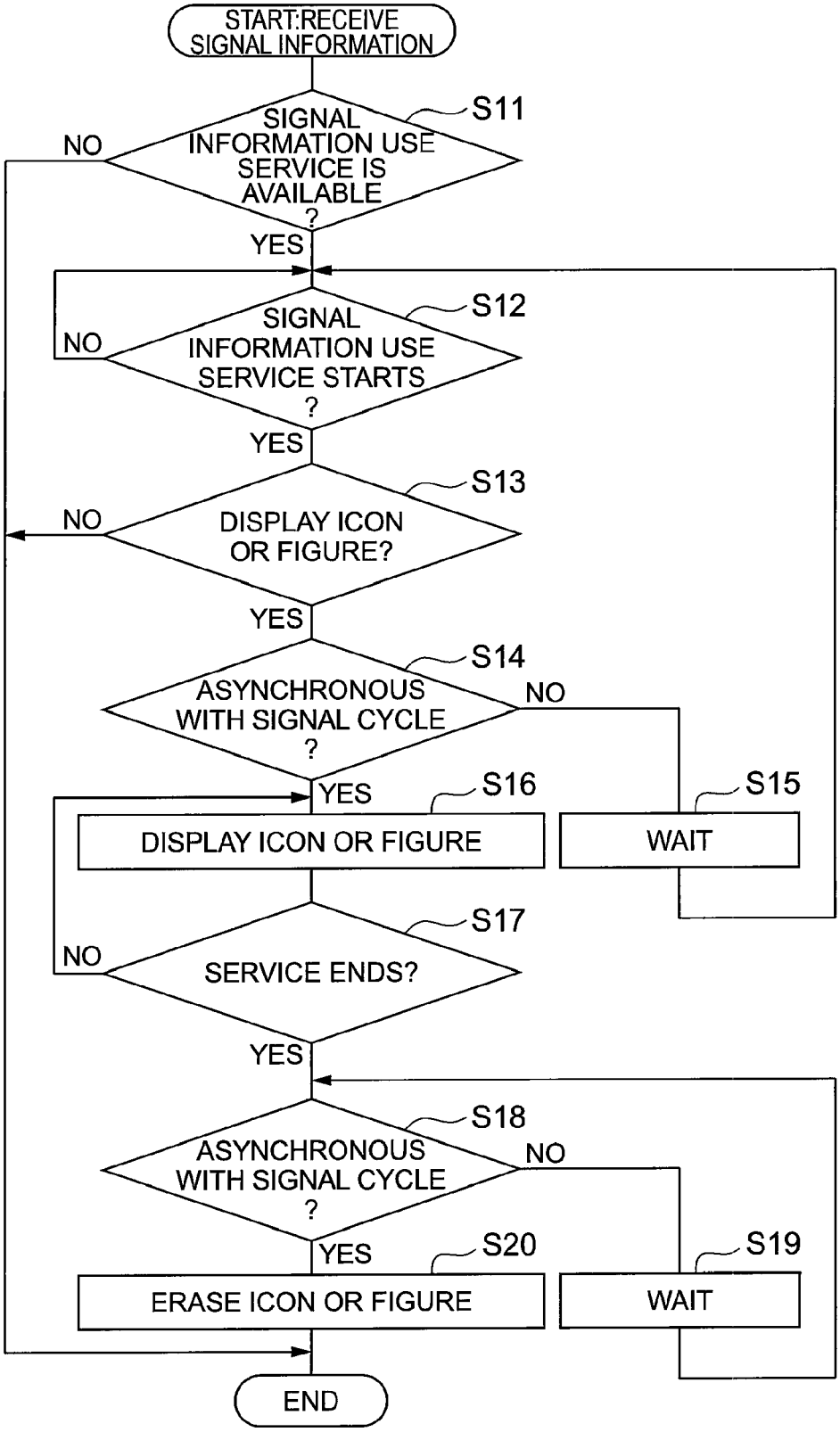
FIG. 2 is a flowchart showing an operation of a drive support device according to the first embodiment.

Hereinafter, the operation of the drive support device 100 of this embodiment will be described. FIG. 2 is a flowchart showing the operation of the drive support device according to the first embodiment. As shown in FIG. 2, the infrastructure cooperation ECU 110 receives time-series signal information relating to the lighting state of a signal from an optical beacon transmitter of a road-side infrastructure or a vehicle-to-vehicle communication device by the receiver 130 or acquires previous time-series signal information relating to the lighting state of a signal at each location recorded in the storage device 120.

The infrastructure cooperation ECU 110 determines whether or not a signal waiting time notification service is available on the basis of the acquired signal information as a prerequisite (S11). When the remaining time until the red signal of the signal changes is shorter than a predetermined time (for example, 1 to 5 seconds), when the remaining time until the red signal of the signal changes cannot be specified, or when data is unknown, the infrastructure cooperation ECU 110 does not carry out the signal waiting time notification service (S11).

The infrastructure cooperation ECU 110 determines whether or not the service using the acquired signal information starts (S12). When there is within a service area or when the vehicle speed has a predetermined value (equal to or lower than 1 to 5 km/h), the infrastructure cooperation ECU 110 starts the service using the signal information (S12).

In the service using the signal information, as described below, the infrastructure cooperation ECU 110 determines whether or not to display an icon or figure corresponding to the service (S13). In this case, an icon is, for example, an icon on a navigation screen of the display 116 or an icon of a meter or the like of a dashboard.

In the service using the signal information, as described below, when an icon or figure corresponding to the service is displayed (S13), the infrastructure cooperation ECU 110 determines whether or not the current time is synchronous with a signal cycle (S14). The situation that the current time is synchronous with the signal cycle means, for example, that the current time is the time at which the signal is switched to the red signal, the current time is the time at which the signal is switched to the green signal, or the like.

When the current time is synchronous with the signal cycle (S14), the infrastructure cooperation ECU 110 waits until the current time is asynchronous with the signal cycle (S15). Meanwhile, when the current time is asynchronous with the signal cycle, the infrastructure cooperation ECU 110 displays an icon or figure corresponding to the service on the display 114 (S16).

Figure 3:
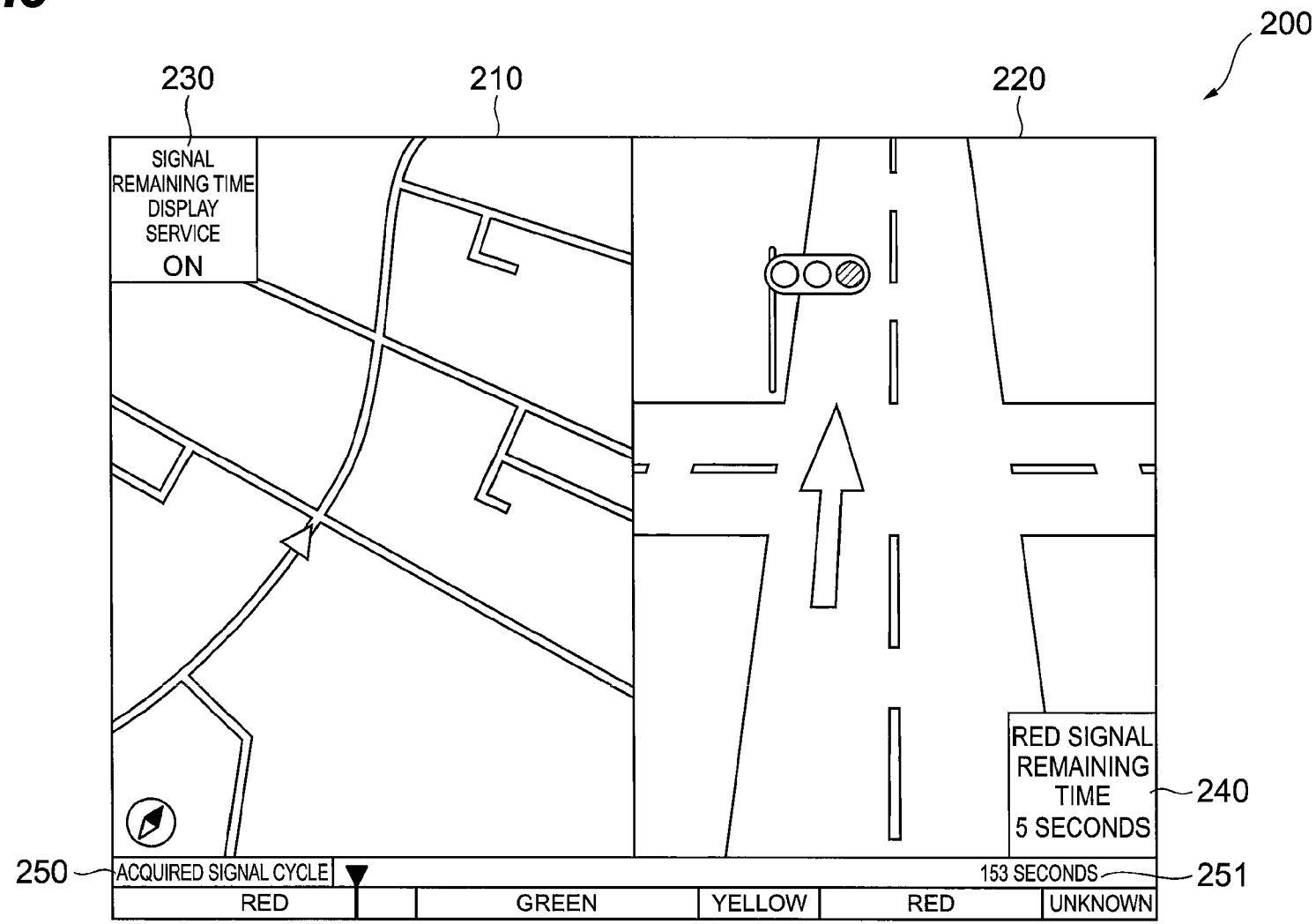
FIG. 3 is a diagram showing an example of a display screen at the time of execution of a signal waiting time notification service.

FIG. 3 is a diagram showing an example of a display screen when a signal waiting time notification service is executed. As shown in FIG. 3, in the screen display 200 of the display 114, 2D map display representing the current position of the host vehicle is arranged in the left half surface, and 3D driver's view display 220 around an intersection through which the host vehicle is currently passing is arranged in the right half surface.

Since it is difficult for the driver to determine whether or not the signal waiting time notification service is executable, in order that the driver easily understands, in this embodiment, the service execution display icon 230 which represents the signal waiting time notification service being in execution is displayed in the screen display 200, and the remaining time of the red signal is displayed in the signal remaining time display icon 240 at an interval of 5 seconds. Alternatively, a notification regarding whether or not the signal waiting time notification service is executable may be made in advance through voice by the speaker 116.

In this embodiment, the time at which the remaining time of the red signal is displayable is displayed inside the screen display 200. For example, when the lighting time of each of a plurality of red signals are identified from the acquired signal information, if signals next to some red signals are unknown, the acquired signal information is displayed in a signal cycle display bar 250, and the time at which the remaining time of the red signal from the acquisition of the signal information is displayable is displayed in acquired signal cycle time display 251.

The infrastructure cooperation ECU 110 determines whether or not a service end condition is established (S17). In this case, examples of the service end condition include when the vehicle speed is equal to or higher than a predetermined value (1 to 5 km/h), when the host vehicle moves outside the service area, when the driver selects a service end setting, when the acquired signal information expires, when the driver presses down the accelerator pedal, and the like.

When the service end condition is established (S17), as in S14, the infrastructure cooperation ECU 110 determines whether or not the current time is synchronous with the signal cycle (S18). When the current time is synchronous with the signal cycle (S18), the infrastructure cooperation ECU 110 waits until the current time is asynchronous with the signal cycle (S19). Meanwhile, when the current time is asynchronous with the signal cycle, the infrastructure cooperation ECU 110 erases an icon or figure corresponding to the service on the display 114 (S20).

In this embodiment, the signal cycle is not synchronized with the timing of the start of displaying an icon or figure corresponding to the service. For this reason, when the signal information is received, when the host vehicle enters the service area, when the engine starts, and when a predetermined time elapses from the signal switching time may be set as the time at which the display of an icon or figure corresponding to the service starts.

In this embodiment, the signal cycle is not synchronized with the timing of the end of displaying an icon or figure corresponding to the service. Thus, when a predetermined time elapses from the start of displaying an icon or the like corresponding to the service, when a predetermined time elapses from the signal switching time, when the driver takes an action (accelerator ON, brake OFF, or the like), when the host vehicle moves outside the service area, when a control quantity is satisfied, for example, the vehicle speed being equal to or lower than a predetermined value, and when the engine starts may be set as the time at which the display of an icon or figure corresponding to the service ends.

In this embodiment, in addition to the signal information received from the receiver 130, the signal information may be acquired by the camera 119 or the like, and the remaining time of the red signal or the like may be displayed. In this embodiment, in the same manner as described above, it is possible to prevent the change time of the display content of an icon or figure corresponding to the service from being synchronized with the signal cycle.

In this embodiment, in the drive support device 100 in which the receiver 130 acquires the time-series signal information relating to the lighting state of the signal, and the display 114 and the speaker 116 provides the information created on the basis of the signal information acquired by the receiver 130 through at least one of the screen display 200 and voice, the display 114 and the speaker 116 provides the information created on the basis of the signal information while preventing at least any timing of the start of providing the information created on the basis of the signal information, the end of providing the information created on the basis of the signal information, and changing the information created on the basis of the signal information to be provided from being synchronized with the timing at which the lighting state of the signal changes. Thus, the timing becomes inconsistent with the change of the lighting state of the signal, making it impossible for the driver to estimate the lighting state of the signal from the information to be provided. Therefore, it becomes possible to prevent the driver from neglecting the confirmation of the signal.

In this embodiment, the display 114 provides the information created on the basis of the signal information through the screen display, and the timing of the start and end of providing the information and changing the information becomes inconsistent with the change of the lighting state of the signal. Therefore, it becomes possible to prevent the driver from neglecting the visual confirmation of the signal.

In this embodiment, the display 114 and the speaker 116 provide the information created on the basis of the signal information while setting at least any timing of the start of providing the information created on the basis of the signal information, the end of providing the information created on the basis of the signal information, and changing the information created on the basis of the signal information to be provided as when a predetermined time elapses after the lighting state of the signal changes. Thus, it is necessary for the driver to confirm the lighting state of the signal after having been actually changed, making it possible to more reliably prevent the driver from neglecting the confirmation of the signal.

In this embodiment, the display 114 and the speaker 116 provide the information created on the basis of the signal information while setting at least any timing of the start of providing the information created on the basis of the signal information, the end of providing the information created on the basis of the signal information, and changing the information created on the basis of the signal information to be provided as when the vehicle state quantity of the host vehicle unrelated to the timing at which the lighting state of the signal changes is in a predetermined state. Therefore, it is possible to prevent the timing of the start of the information created on the basis of the provision of the signal information or the like from being consistent with the timing at which the lighting state of the signal changes, making it possible to prevent the driver from neglecting the confirmation of the signal.

In this embodiment, the vehicle state quantity is at least one of the the vehicle speed, the traveling distance, and the position of the host vehicle. Thus, when at least one of the vehicle speed, the traveling distance, and the position of the host vehicle unrelated to the timing at which the lighting state of the signal changes is in a predetermined state, the display 114 and the speaker 116 start to provide the information created on the basis of the signal information or the like. Therefore, it is possible to prevent the timing of the start of providing the information created on the basis of the signal information or the like from being consistent with the timing at which the lighting state of the signal changes, making it possible to prevent the driver from neglecting the confirmation of the signal.

Figure 4:
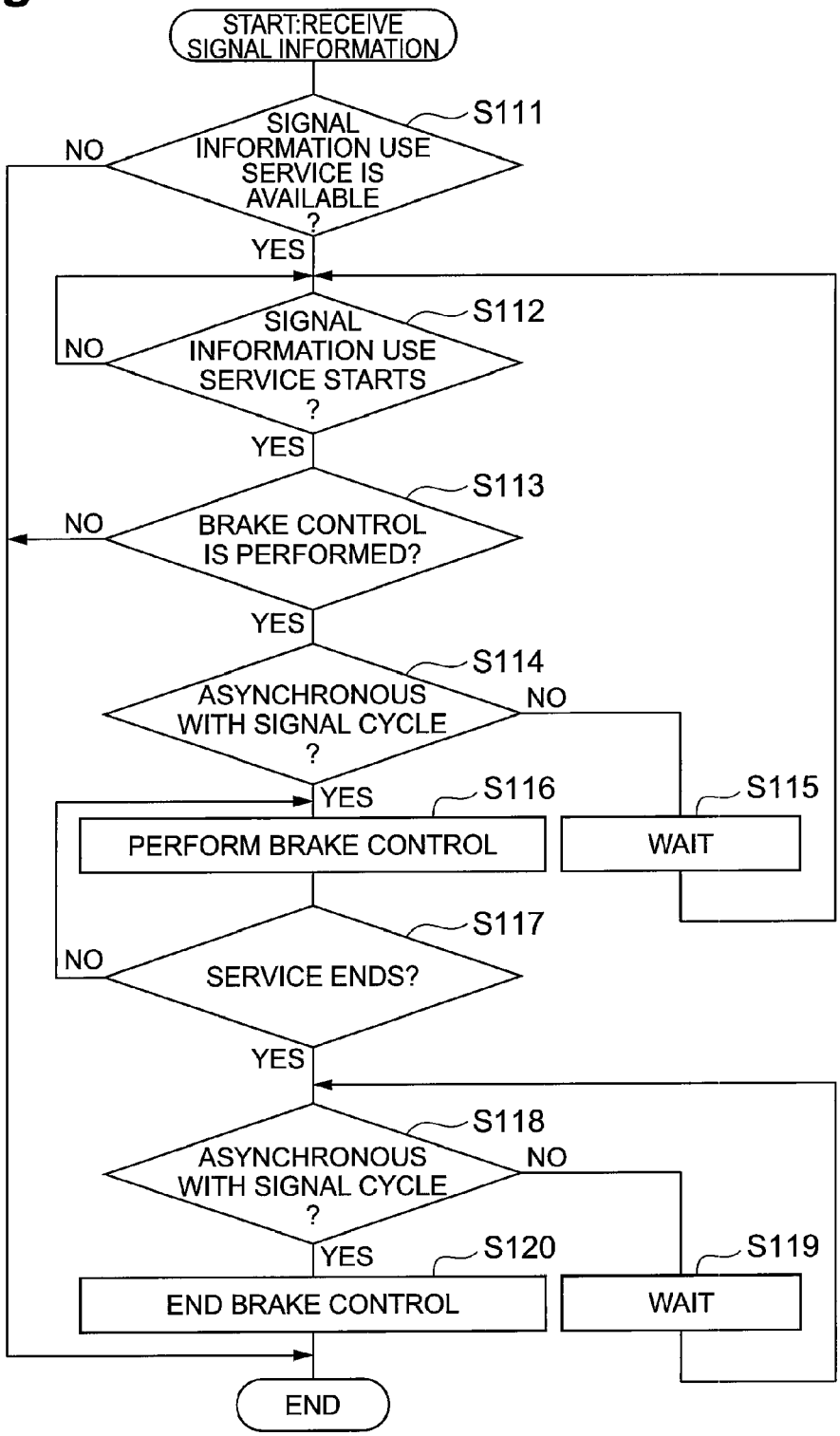
FIG. 4 is a flowchart showing an operation of a drive support device according to a second embodiment.

FIG. 4 is a flowchart showing an operation of a drive support device according to a second embodiment. As shown in FIG. 4, this embodiment is different from the foregoing first embodiment in that the timing of the start of vehicle control and the timing of the end of vehicle control are prevented from being synchronized with the signal cycle.

As shown in FIG. 4, in this embodiment, after S111 and S112 are carried out in the same manner as in S11 and S12 of FIG. 2, in the service using the signal information, when brake control is performed (S113), the infrastructure cooperation ECU 110 determines whether or not the current time is synchronous with the signal cycle (S114).

When the current time is synchronous with the signal cycle (S114), the infrastructure cooperation ECU 110 waits until the current time is asynchronous with the signal cycle (S115). Meanwhile, when the current time is asynchronous with the signal cycle, the infrastructure cooperation ECU 110 sends a command signal to the brake ECU 122, and the brake ECU 122 drives the brake actuator 124 to perform brake control (S116).

When the service end condition is satisfied (S117), as in S114, the infrastructure cooperation ECU 110 determines whether or not the current time is synchronous with the signal cycle (S118). When the current time is synchronous with the signal cycle (S118), the infrastructure cooperation ECU 110 waits until the current time is asynchronous with the signal cycle (S119). Meanwhile, when the current time is asynchronous with the signal cycle, the infrastructure cooperation ECU 110 sends a command signal to the brake ECU 122 and ends brake control (S120).

According to this embodiment, in the drive support device 100 in which the receiver 130 acquires the time-series signal information relating to the lighting state of the signal, and the brake ECU 122 and the accelerator ECU 126 carry out drive support of the host vehicle using the signal information acquired by the receiver 130, the brake ECU 122 and the accelerator ECU 126 carry out the drive support while preventing at least any timing of the start of the drive support and the end of the drive support from being synchronized with the timing at which the lighting state of the signal changes. Thus, the timing becomes inconsistent with the change of the lighting state of the signal, making it impossible for the driver to estimate the lighting state of the signal from the timing of the start of drive support or the like. Therefore, it becomes possible to prevent the driver from neglecting the confirmation of the signal.

According to this embodiment, the brake ECU 122 carries out the drive support while preventing the timing of the start of brake control or the like for most directly coping with the change in the lighting color of the signal from being synchronized with the timing at which the lighting state of the signal changes. Thus, the timing of the start of brake control or the like becomes inconsistent with the change of the lighting state of the signal, making it impossible for the driver to estimate the lighting state of the signal from the timing of the start of brake control or the like. Therefore, it becomes possible to prevent the driver from neglecting the confirmation of the signal.

Although the embodiments of the invention have been described, the invention is not limited to the foregoing embodiments, and various modifications may be made.

INDUSTRIAL APPLICABILITY

According to the invention, it becomes possible to prevent the driver from neglecting the confirmation of the signal.

The invention claimed is:

1. A drive support device equipped in a host vehicle comprising:

an acquisition unit which acquires time-series signal information relating to the lighting state of a signal; and an information providing unit which provides signal status information created on the basis of the signal information acquired by the acquisition unit to a driver of the host vehicle through at least one of screen display and voice, wherein the start, the end, or any change of the signal status information presented to the driver is asynchronous with the timing of changes in the lighting state of the signal.

2. A drive support according to claim 1, wherein the information providing unit provides the signal status information created on the basis of the signal information to the driver of the host vehicle through screen display.

3. The drive support device according to claim 1, wherein the start, end, or change in the signal status information presented to the driver occurs when a predetermined time elapses after the lighting state of the signal changes.

4. The drive support device according to claim 1, wherein the start, end, or change in the signal status information presented to the driver occurs when the vehicle state quantity of a host vehicle is in a predetermined state.

5. The drive support device according to claim 4, wherein the vehicle state quantity is at least one of the vehicle speed, the traveling distance, and the position of the host vehicle.

6. A drive support device equipped in a host vehicle comprising:

an acquisition unit which acquires time-series signal information relating to the lighting state of a signal; and a drive support unit which carries out driver support of the host vehicle using the signal information acquired by the acquisition unit, wherein the start and the end of the driver support is asynchronous with the timing at which the lighting state of the signal changes.

7. The drive support device according to claim 6, wherein the drive support unit controls the brake of the host vehicle to carry out the drive support.

8. The drive support device according to claim 2, wherein the start, end, or change in the signal status information presented to the driver occurs when a predetermined time elapses after the lighting state of the signal changes.

9. The drive support device according to claim 2, wherein the start, end, or change in the signal status information presented to the driver occurs when the vehicle state quantity of the host vehicle is in a predetermined state.

10. The drive support device according to claim 9, wherein the vehicle state quantity is at least one of the vehicle speed, the traveling distance, and the position of the host vehicle.

* * * * *

UNITED STATES PATENT AND TRADEMARK OFFICE

CERTIFICATE OF CORRECTION

PATENT NO. : 8,558,719 B2
APPLICATION NO. : 13/142221
DATED : October 15, 2013
INVENTOR(S) : Yuki Yamada It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 19 days.

Signed and Sealed this
Fifteenth Day of September, 2015

Michelle K. Lee

Michelle K. Lee
*Director of the United States Patent and Trademark Office*